US009474383B1

(12) United States Patent
Roberts et al.

(10) Patent No.: US 9,474,383 B1
(45) Date of Patent: Oct. 25, 2016

(54) DECK PANEL WITH AIRFLOW STIMULATION AND MOISTURE RELEASE ELEMENTS

(71) Applicant: Oddello Industries, LLC, Morristown, TN (US)

(72) Inventors: Thomas A. Roberts, Dandridge, TN (US); Shawn M. Parella, Morristown, TN (US)

(73) Assignee: Oddello Industries, LLC, Morristown, TN (US)

( * ) Notice: Subject to any disclaimer, the term of this patent is extended or adjusted under 35 U.S.C. 154(b) by 0 days.

(21) Appl. No.: 14/512,997

(22) Filed: Oct. 13, 2014

Related U.S. Application Data

(63) Continuation-in-part of application No. 14/485,377, filed on Sep. 12, 2014, now Pat. No. 9,139,332.

(51) Int. Cl.
*A47C 19/02* (2006.01)

(52) U.S. Cl.
CPC ..... *A47C 19/02* (2013.01); *A47C 19/025* (2013.01)

(58) Field of Classification Search
CPC .. A47C 19/005; A47C 27/085; A47C 19/02; A47C 19/021; A47C 19/025; A47C 19/00
See application file for complete search history.

(56) References Cited

U.S. PATENT DOCUMENTS 2,618,429 A * 11/1952 Donnell ..... B65D 5/68 229/120.1
4,105,152 A * 8/1978 Elward ..... B65D 5/2047 229/112
4,354,288 A * 10/1982 Dennis ..... A47C 19/021 108/56.1
5,072,469 A * 12/1991 Boyd ..... A47C 27/081 5/665
5,086,528 A * 2/1992 Miller ..... A47C 27/081 156/308.4
5,231,718 A * 8/1993 Blaha ..... A47C 27/088 5/719
5,253,377 A * 10/1993 Larson ..... A47C 27/085 267/122
5,503,324 A * 4/1996 Bacchetti ..... B65D 71/36 229/112
5,577,659 A * 11/1996 Ades ..... B65D 5/68 229/122.27
5,749,111 A * 5/1998 Pearce ..... A43B 13/04 428/137
5,839,651 A * 11/1998 Teags ..... B65D 5/22 206/511
5,842,241 A * 12/1998 Cooper ..... A47C 27/085 5/670
6,502,698 B1 * 1/2003 McKenna ..... B65D 5/0015 206/509
6,832,397 B2 * 12/2004 Gaboury ..... A47C 19/005 5/201
6,966,085 B1 * 11/2005 Cretsinger ..... A47C 27/065 5/201
8,459,534 B2 * 6/2013 Bradford ..... B65D 5/4266 206/427
2002/0069462 A1 * 6/2002 Gaboury ..... A47C 19/005 5/201
2004/0078897 A1 * 4/2004 Gladney ..... A47C 19/021 5/400
2005/0028275 A1 * 2/2005 Hooper, Jr. ..... A47C 19/025 5/400
2005/0034233 A1 * 2/2005 Gladney ..... A47C 17/86 5/400

(Continued)

*Primary Examiner* — David E Sosnowski
*Assistant Examiner* — Eric Kurilla
(74) *Attorney, Agent, or Firm* — Shaddock Law Group, PC

(57) ABSTRACT

A panel including a portion of material having a top surface and a bottom surface; and a plurality of drain apertures formed through the panel at spaced apart locations, wherein the drain apertures provide determined locations for a flow of fluid between the top surface and the bottom surface of the panel, wherein each of the drain apertures defines a resiliently deformable projection that extends into the drain aperture.

19 Claims, 8 Drawing Sheets

(56) References Cited

U.S. PATENT DOCUMENTS

2005/0039259 A1* 2/2005 Gladney ..... A47C 17/86 5/400
2005/0091745 A1* 5/2005 Kong ..... A47C 19/025 5/201
2005/0120478 A1* 6/2005 Hofmann ..... A47C 19/021 5/400
2005/0150054 A1* 7/2005 Sato ..... A47C 27/085 5/665
2007/0138244 A1* 6/2007 England ..... B65D 5/324 229/125.32
2009/0056030 A1* 3/2009 Bolden ..... A47C 27/006 5/713
2010/0154118 A1* 6/2010 Pearce ..... A47C 19/021 5/201
2010/0175187 A1* 7/2010 Hall ..... A47C 19/005 5/400
2011/0203050 A1* 8/2011 Rogers ..... A47C 19/025 5/285
2011/0271447 A1* 11/2011 Theosabrata ..... A47C 19/025 5/286
2013/0086743 A1* 4/2013 Saunders ..... A47C 27/15 5/400
2015/0289667 A1* 10/2015 Oakhill ..... A47C 21/044 5/423
2015/0296993 A1* 10/2015 Boyd ..... A47C 27/148 5/665

* cited by examiner

DECK PANEL WITH AIRFLOW STIMULATION AND MOISTURE RELEASE ELEMENTS

CROSS-REFERENCE TO RELATED APPLICATIONS

This patent application claims the benefit of U.S. patent application Ser. No. 14/485,377, filed Sep. 12, 2014, the disclosure of which is incorporated herein in its entirety by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to assemblies, support assemblies, foundations, and bases. In particular, the present invention relates to a deck panel with airflow stimulation and moisture release elements.

2. Description of Related Art

Typically, mattress foundations and support assemblies include a top deck layer or barrier, upon which a mattress or other element rests. As the mattress sits atop the mattress foundation barrier, airflow between the mattress and foundation barrier is typically nonexistent and, over time, moisture typically builds between the mattress foundation barrier and the mattress. This is particularly true with memory foam type mattresses.

If moisture is allowed to build between the mattress and the mattress foundation barrier, mildew or mold can grow on the mattress and/or a mattress foundation barrier. This can cause premature deterioration of the mattress and/or health issues for anyone sleeping on a mattress.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

To solve these and other problems, the elements of the present invention work to provide improved airflow between the mattress and mattress foundation barrier and to allow efficient removal of accumulated moisture between the mattress and mattress foundation barrier.

In various exemplary, non-limiting embodiments, the deck panel with airflow stimulation and moisture release elements of the present invention comprises a deck panel or deck panel having a plurality of drain apertures formed therethrough, at spaced apart locations. The drain apertures are positioned so as to provide determined locations for the flow of fluid between the top surface and the bottom surface of the deck panel.

Thus, the drain apertures allow for fluid flow or airflow between an item placed atop a support assembly utilizing the deck panel with airflow stimulation and moisture release elements and an interior of the support assembly. For example, moisture or condensation that would typically be trapped between a bottom of a mattress and a top of a mattress support assembly can easily flow through the drain apertures, thereby increasing the life of the mattress and the components of the mattress support assembly and reducing and/or eliminating the possibility of bacteria or mold forming between the mattress and the mattress support assembly.

To further enhance the efficiency of the airflow stimulation and moisture release, the drain apertures define a triangularly shaped "drip tip" projection that is able to flex in order to stimulate increased airflow and direct the moisture in a determined direction.

In various exemplary embodiments, the deck panel or barrier structure is constructed of paper, cardboard, fabric, high-density polyethylene, plastic, and/or material or materials.

Accordingly, this invention provides a barrier structure for a support assembly of improved design.

This invention separately provides a barrier structure for a support assembly that provides improved airflow between the support assembly and a mattress placed atop the support assembly.

This invention separately provides a barrier structure for a support assembly that reduces the amount of moisture buildup between the support assembly and a mattress placed atop the support assembly.

This invention separately provides a barrier structure for a support assembly that can reduce or eliminate the instances of mold buildup on the bottom of a mattress.

This invention separately provides a barrier structure for a support assembly that can direct built-up moisture away from the barrier structure and any mattress placed upon the barrier structure.

These and other aspects, features, and advantages of the present invention are described in or are apparent from the following detailed description of the exemplary, non-limiting embodiments of the present invention and the accompanying figures. Other aspects and features of embodiments of the present invention will become apparent to those of ordinary skill in the art upon reviewing the following description of specific, exemplary embodiments of the present invention in concert with the figures. While features of the present invention may be discussed relative to certain embodiments and figures, all embodiments of the present invention can include one or more of the features discussed herein. Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present invention.

Any benefits, advantages, or solutions to problems that are described herein with regard to specific embodiments are not intended to be construed as a critical, required, or essential feature(s) or element(s) of the present invention or the claims.

BRIEF DESCRIPTION OF THE SEVERAL VIEWS OF THE DRAWINGS

As required, detailed exemplary embodiments of the present invention are disclosed herein; however, it is to be understood that the disclosed embodiments are merely exemplary of the invention that may be embodied in various and alternative forms, within the scope of the present invention. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present invention.

The exemplary embodiments of this invention will be described in detail, with reference to the following figures, wherein like reference numerals refer to like parts throughout the several views, and wherein.

DETAILED DESCRIPTION OF THE INVENTION

Figure 1:
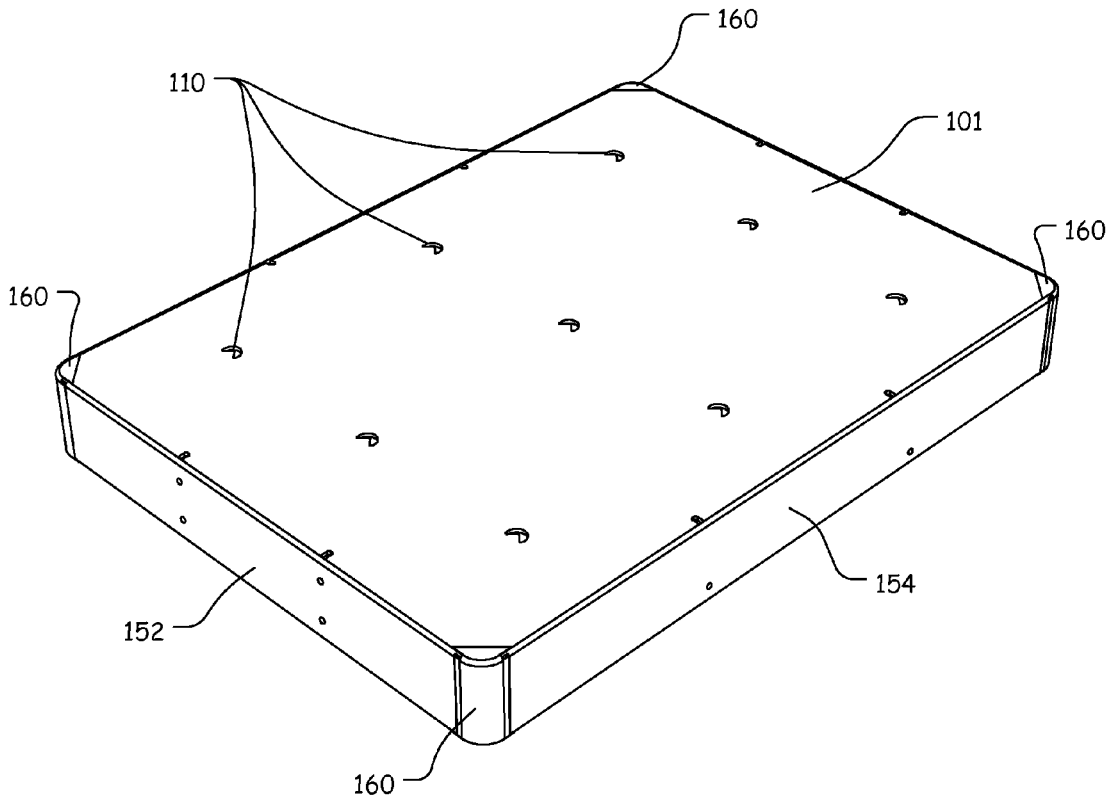
FIG. 1 illustrates a top, perspective view of a first exemplary embodiment of a support assembly incorporating the deck panel with airflow stimulation and moisture release elements, according to this invention.

For simplicity and clarification, the design factors and operating principles of the deck panel with airflow stimulation and moisture release elements according to this invention are explained with reference to various exemplary embodiments of a deck panel with airflow stimulation and moisture release elements according to this invention. The basic explanation of the design factors and operating principles of the deck panel with airflow stimulation and moisture release elements is applicable for the understanding, design, and operation of this invention. It should be appreciated that the deck panel with airflow stimulation and moisture release elements can be adapted to many applications where airflow is restricted and/or moisture is prone to build up between adjacent elements.

Additionally, the deck panel with airflow stimulation and moisture release elements of this invention will be described as being used as part of a support assembly for a mattress foundation. However, it should be appreciated that these are merely exemplary embodiments of the deck panel with airflow stimulation and moisture release elements and are not to be construed as limiting this invention. Thus, the deck panel with airflow stimulation and moisture release elements of this invention may be utilized in conjunction with any application where airflow is restricted and/or moisture is prone to build up between adjacent elements.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled" is defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are open-ended linking verbs. As a result, a system, device, or apparatus that "comprises", "has", "includes", or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations. Thus, it will be understood that these terms are meant to imply the inclusion of a stated element, integer, step, or group of elements, integers, or steps, but not the exclusion of any other element, integer, step, or group of elements, integers, or steps.

It should also be appreciated that the terms "support assembly", "deck panel", and "top deck panel" are used for basic explanation and understanding of the operation of the systems, methods, and apparatuses of this invention. Therefore, the terms "support assembly", "deck panel", and "top deck panel" are not to be construed as limiting the systems, methods, and apparatuses of this invention. Thus, the term "support assembly" is to be understood to broadly include any structures or devices capable of supporting a load, while the terms "deck panel" and "top deck panel" are to be understood to broadly include any structure or element forming a cover, top layer, or cap of a support structure.

Turning now to the drawing FIGS., FIGS. 1 and 3-12 illustrate certain elements and/or aspects of a first exemplary embodiment of a top deck panel with airflow stimulation and moisture release elements, according to this invention. In illustrative, non-limiting embodiment(s) of this invention, as illustrated in FIGS. 1 and 3-12, the deck panel 100 comprises a portion of material having a top surface 101 and a bottom surface 102. As illustrated, the deck panel 100 is substantially rectangular. However, it should be appreciated that the deck panel 100 may comprise any desired geometric shape, including, for example, a substantially circular, triangular, square, rectangular, pentangular, or other desired shape. Thus, it should be understood that the general overall shape of the deck panel 100 is a design choice based on the desired appearance and functionality of the deck panel 100 and/or the support assembly with which the deck panel 100 is to be used.

In certain exemplary, non-limiting embodiments, all or portions of the deck panel 100 may be formed of a fabric or other material, such as, for example, paper, cardboard, plastic, high-density polyethylene, Tyvek®, fabrics, woven fabrics, canvas, acrylics, sheet fabrics, films, nylon, spandex, vinyl, Polyvinyl Chloride (PVC), neoprene, and/or other material or materials, which provide a top surface or cover for a support assembly. Additionally, all or portions of the deck panel 100 may be made of any flexible and/or elastic material and may stretch. Alternatively, all or portions of the deck panel 100 may be formed from multiple, similar or dissimilar materials. In various exemplary, nonlimiting embodiments, the deck panel 100 may be water-resistant or water impervious.

It should be appreciated that the terms fabric and material are to be given their broadest meanings and that the particular fabric(s) or material(s) used to form the deck panel 100 is a design choice based on the desired appearance and/or functionality of the deck panel 100.

A plurality of drain apertures 110 are formed through the deck panel 100 at spaced apart locations. The drain apertures 110 are positioned so as to provide determined locations for the flow of fluid between the top surface 101 and the bottom surface 102 of the deck panel 100. Thus, the drain apertures 110 allow for fluid flow or airflow between an item placed atop the support assembly 150 and an interior of the support assembly 150. For example, moisture or condensation that would typically be trapped between a bottom of a mattress 170 and a top of a support assembly 150 can easily flow through the drain apertures 110, thereby increasing the life of the mattress 170 and the components of the support assembly 150 and reducing and/or eliminating the possibility of bacteria or mold forming between the mattress 170 and the support assembly 150.

Figure 8:
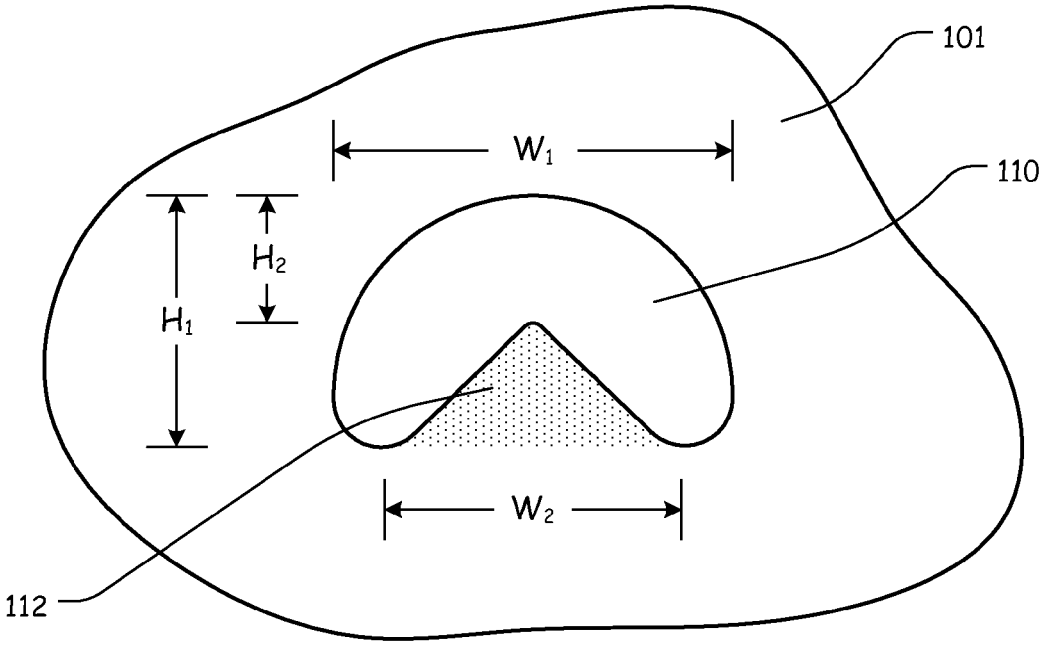
FIG. 8 illustrates a more detailed, top view of a first exemplary embodiment of a single airflow stimulation and moisture release element, according to this invention.
Figure 9:
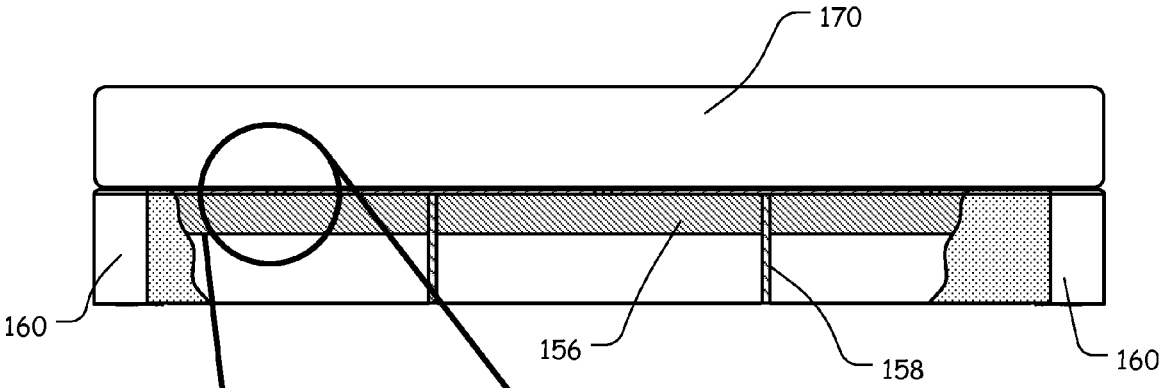
FIG. 9 illustrates a partial cutaway side view showing an exemplary support assembly incorporating the deck panel with airflow stimulation and moisture release elements, according to this invention.
Figure 10:
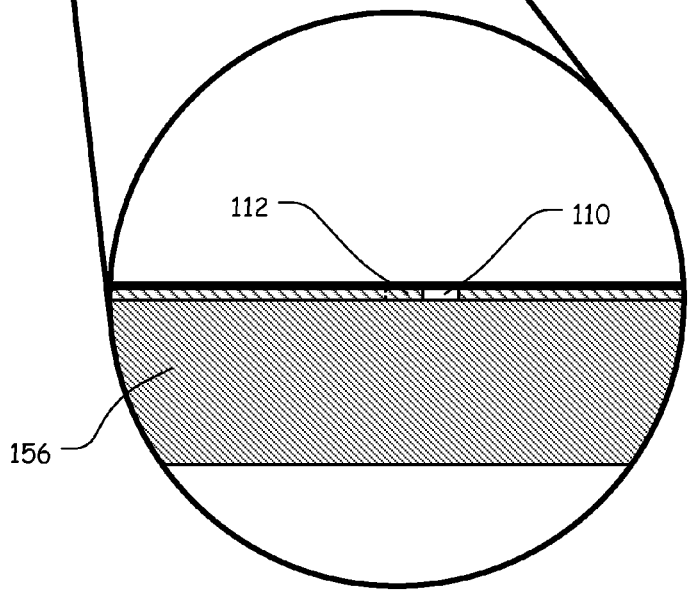
FIG. 10 illustrates a magnified view showing an exemplary airflow stimulation and moisture release element, according to this invention.
Figure 11:
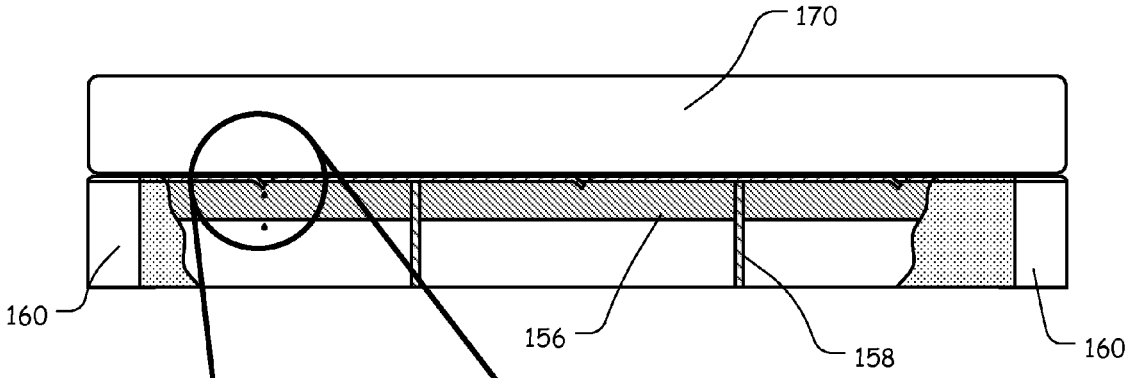
FIG. 11 illustrates a partial cutaway side view showing an exemplary support assembly incorporating the deck panel with airflow stimulation and moisture release elements, wherein the airflow stimulation and moisture release elements are directing moisture in a determined direction, according to this invention.
Figure 12:
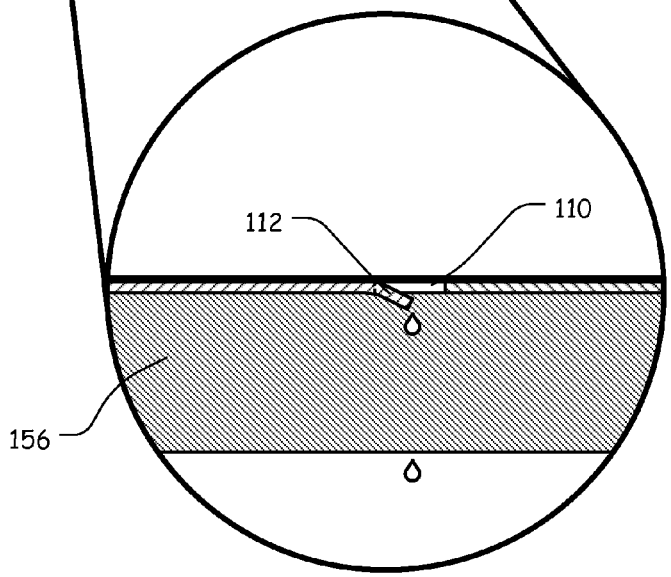
FIG. 12 illustrates a magnified view showing an exemplary airflow stimulation and moisture release element directing moisture in a determined direction, according to this invention.

To further enhance the efficiency of the airflow stimulation and moisture release, the drain apertures 110 are formed in a relative "C", "U", or "V" shape, thereby defining a triangularly shaped "drip tip" projection 112 (as highlighted in FIG. 8). The projection 112 is a resiliently deformable projection 112 that extends into the drain aperture 110. Each projection 112 can flex, bend, or deform downward in order to stimulate increased airflow and direct the moisture in a determined direction.

In various exemplary, nonlimiting embodiments, each drain aperture 110 defines an overall width $W_1$ and an overall height $H_1$. The projection 112 reduces a portion of the overall width $W_1$ to a remaining width of $W_2$ and reduces a portion of the overall height $H_1$ to a remaining height of $H_2$. In certain exemplary embodiments, each drain aperture 110 defines a shape similar to a central, planar cross-section of a sphere having a spherical cone removed.

In certain exemplary, nonlimiting embodiments, as illustrated most clearly in FIGS. 9-12, as moisture or liquid accumulates between a mattress 170 and the top surface 102 of the deck panel 100, the moisture or liquid is funneled toward one of the drain apertures 110. As a sufficient amount of moisture or liquid is accumulated, the weight of moisture or liquid can cause the projection 112 to flex, bend, or deform downward, so as to direct the accumulated moisture or liquid down a top surface of the projection 112, toward a center or other determined portion of the drain aperture 110. When a sufficient amount of moisture or liquid is accumulated on the top surface of the projection 112, the moisture or liquid drips from the projection 112 and is released through the drain aperture 110.

Because the drain apertures 110, and, more specifically, the projections 112, are in one or more determined locations, accumulated moisture or liquid drips from the deck panel at one or more determined locations.

In certain exemplary embodiments, the projections 112 are formed so as to naturally flex, bend, or deform downward, even without any additional weight being present on the top surface of the projections 112. In this manner, liquid or moisture can be more easily funneled toward one of the drain apertures 110. Additionally, airflow can be increased, as the downwardly pointing projections 112 act as an air intake or scoop to create or optimize airflow between the top surface 101 of the deck panel 100 and the bottom surface of the mattress 170.

It should be appreciated that the number, size, shape, and placement of the drain apertures 110 is a design choice based on the desired appearance and functionality of the drain apertures 110 relative to the deck panel 100.

In certain exemplary, nonlimiting embodiments, the deck panel 100 comprises a simple geometric shape that allows the deck panel 100 to be attached or coupled to a top portion of a support assembly, such as, for example, support assembly 150, by being attached or coupled to portions of the support assembly 150.

Figure 3:
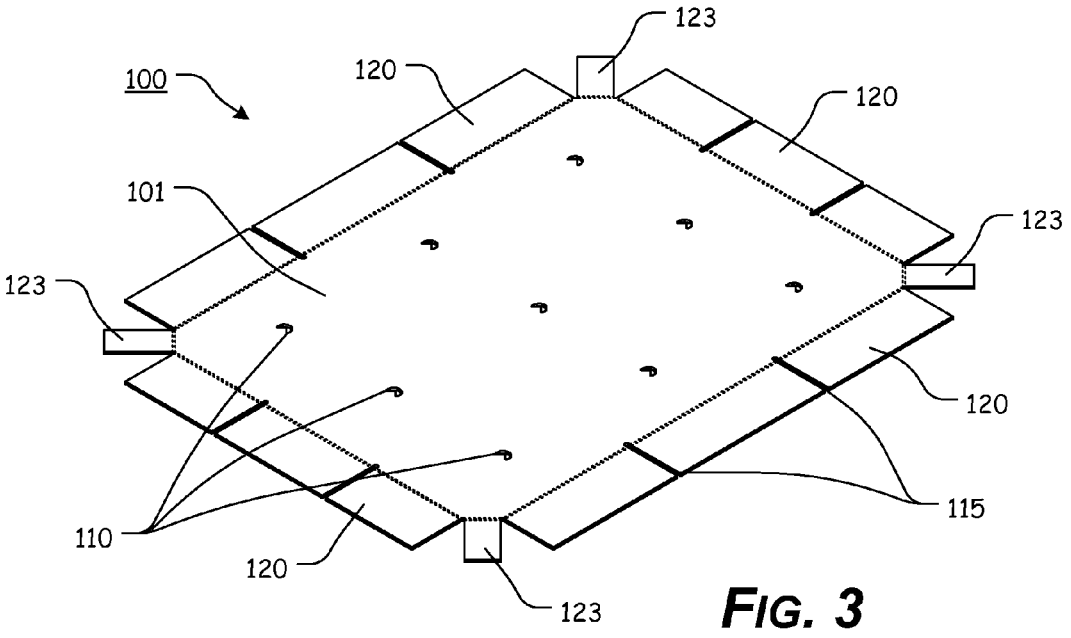
FIG. 3 illustrates a bottom, perspective view of a first exemplary embodiment of a deck panel with airflow stimulation and moisture release elements, according to this invention.
Figure 4:
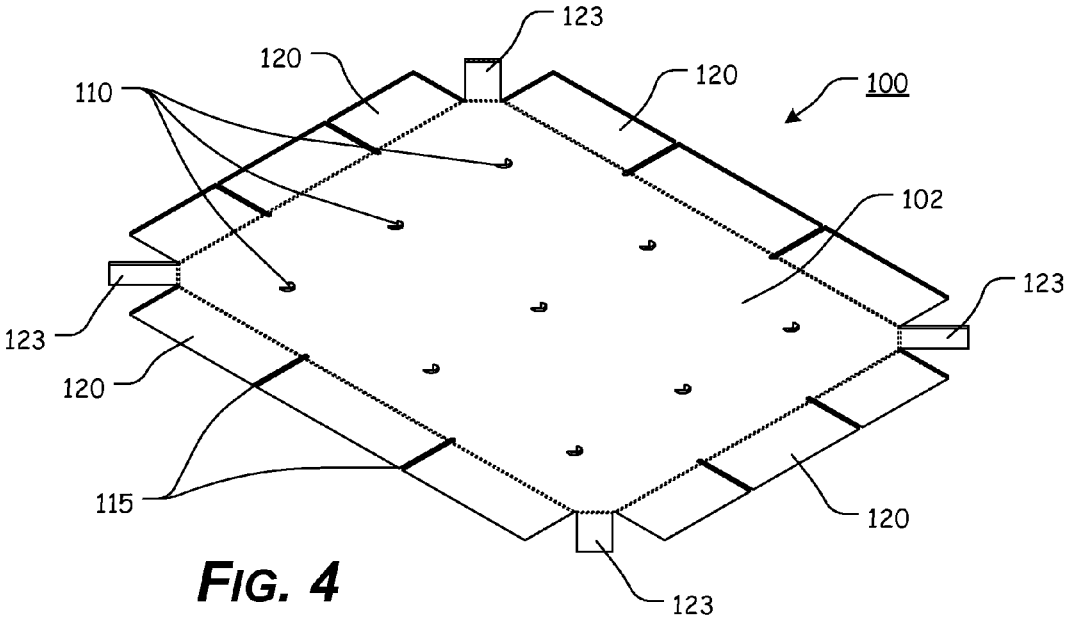
FIG. 4 illustrates a top view of a first exemplary embodiment of a deck panel with airflow stimulation and moisture release elements, according to this invention.
Figure 5:
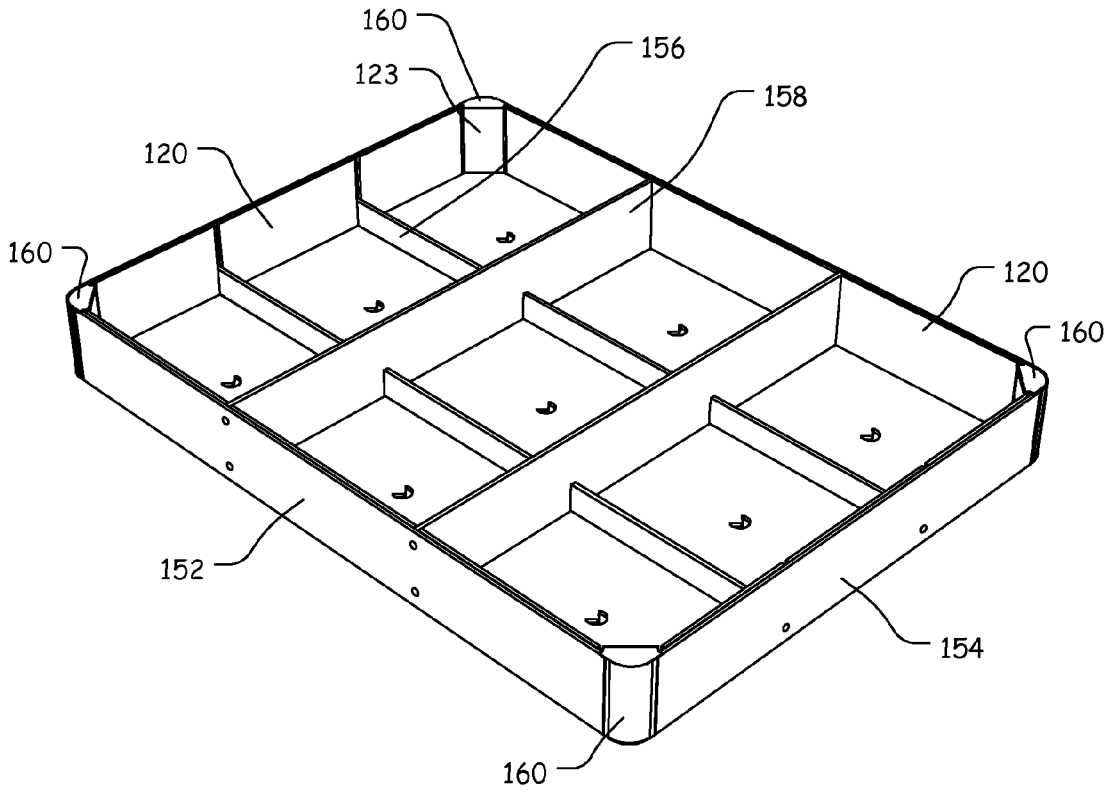
FIG. 5 illustrates a bottom, perspective view of a first exemplary embodiment of a support assembly incorporating the deck panel with airflow stimulation and moisture release elements, according to this invention.
Figure 6:
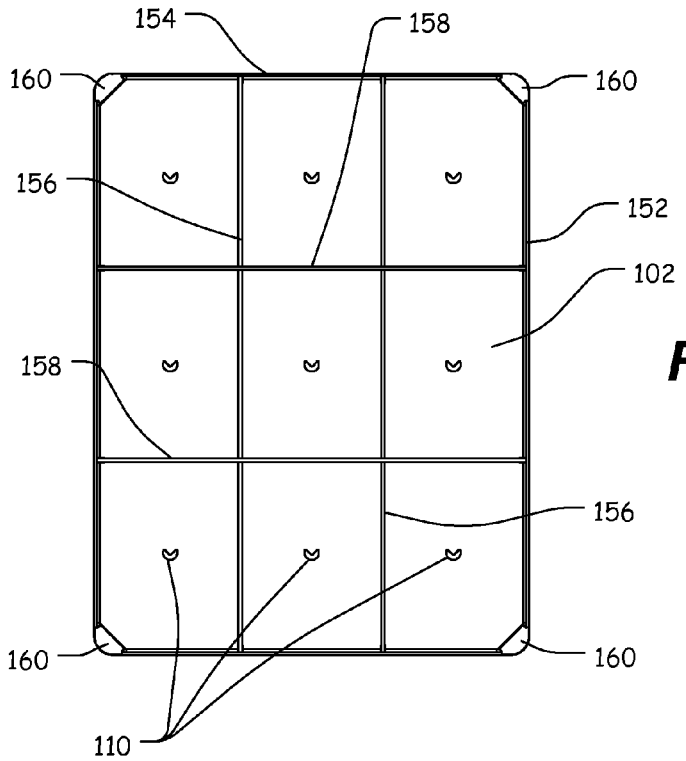
FIG. 6 illustrates a bottom view of a first exemplary embodiment of a support assembly incorporating the deck panel with airflow stimulation and moisture release elements, according to this invention.
Figure 7:
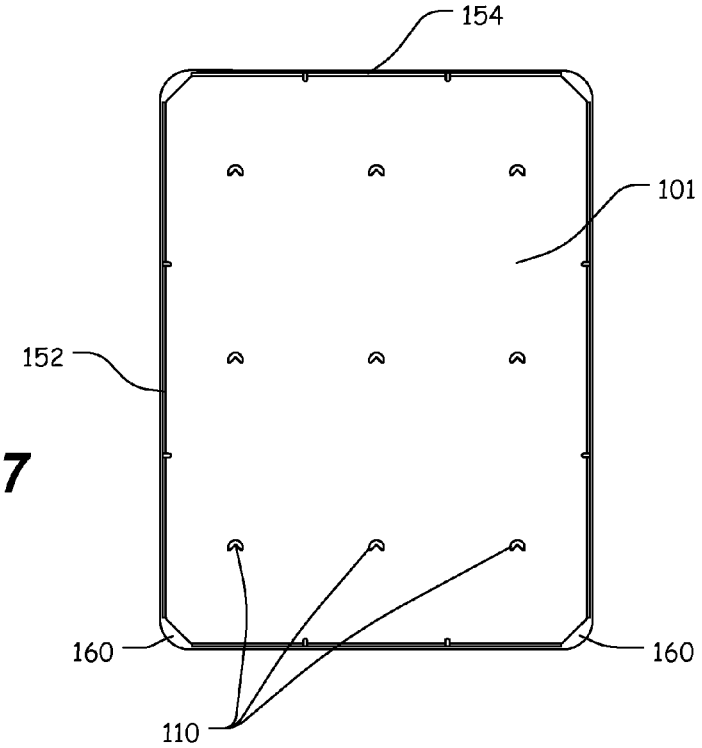
FIG. 7 illustrates a top view of a first exemplary embodiment of a support assembly incorporating the deck panel with airflow stimulation and moisture release elements, according to this invention.

Alternatively, as illustrated in FIGS. 3-5, the deck panel 100 may comprise a more complex shape that includes recesses, extensions, and or other attachment features that allow the deck panel 100 to be attached or coupled to a support assembly 150.

As illustrated, the deck panel 100 may optionally extend to include side flaps 120, which extend generally along each side of the deck panel 100. Corner flaps 123 may optionally extend generally from each corner of the deck panel 100. While the corner flaps 123 and the side flaps 120 each extend from the deck panel 100, the corner flaps 123 are separate from the side flaps 120.

The side flaps 120 may further include one or more panel notches 115 formed through at least a portion of the side flaps 120. The panel notches 115 are formed so as to allow at least an end portion of a spine element 156 or rib element 158 of an associated support assembly 150 to pass therethrough, as described in more detail below.

It should be appreciated that while FIGS. 3-5 illustrate the deck panel 100 having a more complex shape, these exemplary embodiments are merely illustrative and should not be viewed as limiting the features and/or elements of the present invention.

Figure 2:
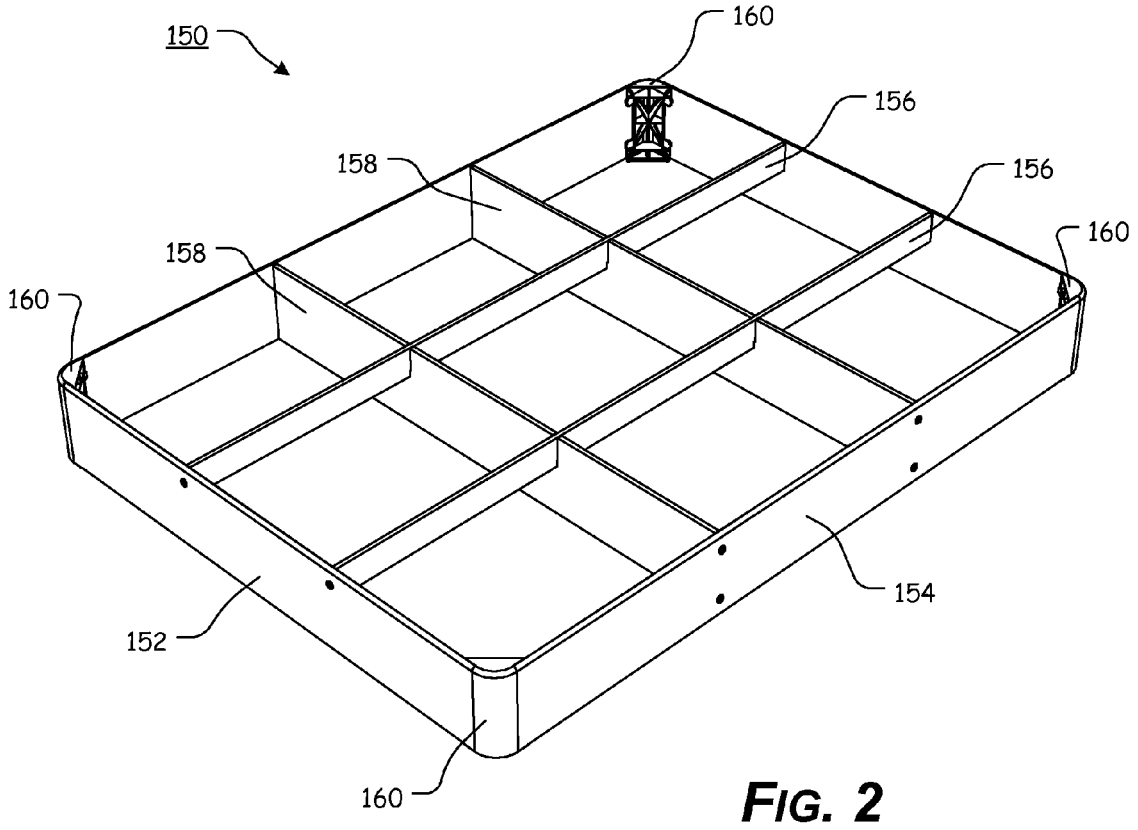
FIG. 2 illustrates a top, perspective view of a first exemplary embodiment of a support assembly that could be utilized with the deck panel with airflow stimulation and moisture release elements, according to this invention.

While it should be understood that the deck panel 100 can be utilized in conjunction with any desired support frame or support assembly, in various exemplary embodiments, the deck panel 100 may be utilized in connection with the exemplary support assembly 150. As illustrated most clearly in FIG. 2, the support assembly 150 comprises at least some of a plurality of shaped perimeter or side rail elements 152 and 154, spine elements 156, rib elements 158, and optional corner connector elements 160.

In various exemplary embodiments, the support assembly 150 comprises the rapid assembly support structure as shown and described in pending U.S. patent application Ser. No. 14/485,377, filed Sep. 12, 2014, the disclosure of which is incorporated herein in its entirety by reference.

While this invention has been described in conjunction with the exemplary embodiments outlined above, the foregoing description of exemplary embodiments of the invention, as set forth above, are intended to be illustrative, not limiting and the fundamental invention should not be considered to be necessarily so constrained. It is evident that the invention is not limited to the particular variation set forth and many alternatives, adaptations modifications, and/or variations will be apparent to those skilled in the art.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the invention, such that others may, by applying current knowledge, change, vary, modify, and/or adapt these exemplary, non-limiting embodiments for various applications without departing from the spirit and scope of the invention and elements or methods similar or equivalent to those described herein can be used in practicing the present invention. Any and all such changes, variations, modifications, and/or adaptations should and are intended to be comprehended within the meaning and range of equivalents of the disclosed exemplary embodiments and may be substituted without departing from the true spirit and scope of the invention.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A support assembly with airflow stimulation and moisture release elements, comprising:

a panel comprising a portion of material having a top surface and a bottom surface, wherein portions of said panel extend to side flaps;

a plurality of drain apertures formed through said panel at spaced apart locations, wherein said drain apertures provide determined locations for a flow of fluid between said top surface and said bottom surface of said panel, wherein each of said drain apertures defines a resiliently deformable projection that extends into said drain aperture;

a plurality of side rail elements, wherein each side rail element comprises an elongate portion of material extending between two opposing notched end portions, wherein said side rail elements are affixed to at least a portion of said top surface of said deck panel, atop at least a portion of said side flaps;

one or more spine elements, wherein each spine element comprises an elongate portion of material having one or more spine element notches formed along an upper portion thereof;

one or more rib elements, wherein each rib element comprises an elongate portion of material having one or more rib element notches formed along a lower portion thereof, wherein said rib element notches are shaped so as to interact with said spine element notches; and corner connector elements, wherein each corner connector element includes corner connector slots arranged approximately 90° relative to each other, and wherein each corner connector slot is formed so as to accept at least a portion of said notched end portion of said side rail element.

2. The support assembly of claim 1, wherein said panel is substantially planar.

3. The support assembly of claim 1, wherein said panel is substantially rectangular, circular, triangular, square, rectangular, or pentangular.

4. The support assembly of claim 1, wherein at least a portion of said panel is formed of paper, cardboard, plastic, high-density polyethylene, flashspun high-density polyethylene fibers, a nonwoven product comprising spunbond olefin fiber, fabrics, woven fabrics, canvas, acrylics, sheet fabrics, films, nylon, spandex, vinyl, Polyvinyl Chloride (PVC), and/or neoprene.

5. The support assembly of claim 1, wherein at least a portion of said panel is water-resistant.

6. The support assembly of claim 1, wherein at least a portion of said panel is water impervious.

7. The support assembly of claim 1, wherein said drain apertures allow for fluid flow or airflow between an item placed atop said panel and bottom surface of said panel.

8. The support assembly of claim 1, wherein said drain apertures are formed in a relative "C", "U", or "V" shape.

9. The support assembly of claim 1, wherein each resiliently deformable projection can flex, bend, or deform downward in order to stimulate increased airflow and direct accumulated moisture in a determined direction.

10. The support assembly of claim 1, wherein each resiliently deformable projection is a triangularly shaped projection.

11. The support assembly of claim 1, wherein each drain aperture defines an overall width and an overall height and wherein each resiliently deformable projection reduces a portion of said overall width and reduces a portion of said overall height.

12. The support assembly of claim 1, wherein each drain aperture defines a shape similar to a circle, which is obtained by a central, planar cross-section of a sphere having a spherical cone removed.

13. The support assembly of claim 1, wherein if moisture or liquid accumulates between a mattress and said top surface of said panel, said moisture or liquid is funneled toward a resiliently deformable projection.

14. The support assembly of claim 1, wherein if a sufficient amount of moisture or liquid is accumulated on said top surface of said resiliently deformable projection, said moisture or liquid drips from said resiliently deformable projection.

15. The support assembly of claim 1, wherein said resiliently deformable projections naturally flex, bend, or deform downward to increase airflow between said top surface of said panel and said bottom surface of said panel.

16. A support assembly with airflow stimulation and moisture release elements, comprising:

a panel comprising a portion of material having a top surface and a bottom surface, wherein portions of said panel extend to side flaps, and wherein at least a portion of said panel is water impervious;

a plurality of drain apertures formed through said panel at spaced apart locations, wherein said drain apertures provide determined locations for a flow of fluid between said top surface and said bottom surface of said panel, wherein each of said drain apertures defines a resiliently deformable projection that extends into said drain aperture, and wherein each of said resiliently deformable projections naturally flexes, bends, or deforms downward to increase a flow of fluid between said top surface of said panel and said bottom surface of said panel;

a plurality of side rail elements, wherein each side rail element comprises an elongate portion of material extending between two opposing notched end portions, wherein said side rail elements are affixed to said top surface of said deck panel, atop said side flaps;

one or more spine elements, wherein each spine element comprises an elongate portion of material having one or more spine element notches formed along an upper portion thereof;

one or more rib elements, wherein each rib element comprises an elongate portion of material having one or more rib element notches formed along a lower portion thereof, wherein said rib element notches are shaped so as to interact with said spine element notches; and corner connector elements, wherein each corner connector element includes corner connector slots arranged approximately 90° relative to each other, and wherein each corner connector slot is formed so as to accept at least a portion of said notched end portion of said side rail element.

17. A support assembly with airflow stimulation and moisture release elements, comprising:

a deck panel comprising a portion of material having a top surface and a bottom surface, extending to side flaps, wherein said side flaps extend outwardly, along at least a portion of each side of said deck panel, wherein said deck panel further comprises corner flaps, wherein said corner flaps extend outwardly from at least a portion of each corner of said deck panel, and wherein a plurality of substantially "C", "U", or "V" shaped drain apertures are formed through said deck panel at spaced apart locations;

a plurality of side rail elements, wherein each side rail element comprises an elongate portion of material extending between two opposing notched end portions, wherein each side rail element has at least one side rail groove formed on an interior side of said side rail element, perpendicular to a longitudinal axis of said side rail element, wherein said side rail elements are affixed to said top surface of said deck panel, atop said side flaps;

one or more spine elements, wherein each spine element comprises an elongate portion of material having one or more spine element notches formed along an upper portion thereof;

one or more rib elements, wherein each rib element comprises an elongate portion of material having one or more rib element notches formed along a lower portion thereof, wherein said rib element notches are shaped so as to interact with said spine element notches; and corner connector elements, wherein each corner connector element includes corner connector slots arranged approximately 90° relative to each other, and wherein each corner connector slot is formed so as to accept at least a portion of said notched end portion of said side rail element.

18. The deck panel of claim 17, wherein said deck panel is substantially triangular, square, rectangular, or pentangular.

19. The deck panel of claim 17, wherein at least a portion of said deck panel is formed of a fabric, paper, cardboard, plastic, flashspun high-density polyethylene fibers, a nonwoven product comprising spunbond olefin fiber, woven fabrics, canvas, acrylics, sheet fabrics, films, nylon, spandex, vinyl, Polyvinyl Chloride (PVC), or neoprene.

* * * * *